US008567224B2

(12) United States Patent
Martin

(10) Patent No.: US 8,567,224 B2
(45) Date of Patent: Oct. 29, 2013

(54) STRETCHED METAL ARTICLE HAVING REINFORCED TERMINAL EDGE AND METHOD OF MAKING SAME

(75) Inventor: Ross Allan Martin, Lowell, MI (US)

(73) Assignee: Pridgeon & Clay, Inc., Grand Rapids, MI (US)

( * ) Notice: Subject to any disclaimer, the term of this patent is extended or adjusted under 35 U.S.C. 154(b) by 552 days.

(21) Appl. No.: 12/532,485

(22) PCT Filed: Apr. 11, 2008

(86) PCT No.: PCT/US2008/060058

§ 371 (c)(1),
(2), (4) Date: Jan. 26, 2010

(87) PCT Pub. No.: WO2008/128060

PCT Pub. Date: Oct. 23, 2008

(65) Prior Publication Data

US 2010/0139354 A1 Jun. 10, 2010

Related U.S. Application Data

(60) Provisional application No. 60/911,177, filed on Apr. 11, 2007.

(51) Int. Cl.
*B21D 22/00* (2006.01)

(52) U.S. Cl.
USPC ..... 72/348; 72/356

(58) Field of Classification Search
USPC ..... 72/325, 347, 348, 349, 352, 354.6, 72/355.2, 355.4, 356
See application file for complete search history.

(56) References Cited

U.S. PATENT DOCUMENTS

| | | | | |
|---|---|---|---|---|
| 3,601,458 | A | | 8/1971 | Farrell et al. |
| 3,726,244 | A | * | 4/1973 | Arangelovich et al. ..... 72/348 |
| 4,413,497 | A | * | 11/1983 | Kubis et al. ..... 72/348 |
| 5,612,006 | A | * | 3/1997 | Fisk ..... 422/171 |
| 5,658,112 | A | * | 8/1997 | Borasio et al. ..... 72/348 |
| 5,660,212 | A | | 8/1997 | Elder |
| 5,664,329 | A | | 9/1997 | Nickel |
| 6,481,259 | B1 | | 11/2002 | Durney |
| 6,877,349 | B2 | | 4/2005 | Durney et al. |
| 6,926,320 | B2 | | 8/2005 | Garcia et al. |
| 7,032,426 | B2 | | 4/2006 | Durney et al. |
| 7,152,449 | B2 | | 12/2006 | Durney et al. |
| 7,152,450 | B2 | | 12/2006 | Durney et al. |
| 7,222,511 | B2 | | 5/2007 | Durney et al. |
| 7,263,869 | B2 | | 9/2007 | Durney et al. |
| 2005/0218140 | A1 | | 10/2005 | Enoki et al. |

FOREIGN PATENT DOCUMENTS

| | | | |
|---|---|---|---|
| JP | 56-109121 | A | 8/1981 |
| JP | 10-156481 | A | 6/1998 |
| JP | 2002-267014 | A | 9/2002 |
| JP | 2007-016930 | A | 1/2007 |
| WO | 2007/134114 | A2 | 11/2007 |

* cited by examiner

*Primary Examiner* — Teresa M Ekiert
(74) *Attorney, Agent, or Firm* — McGarry Bair PC

(57) ABSTRACT

A reinforced wall in a drawn metal workpiece is formed by folding an annular wall back on itself in a punch-driven operation.

13 Claims, 17 Drawing Sheets

STRETCHED METAL ARTICLE HAVING REINFORCED TERMINAL EDGE AND METHOD OF MAKING SAME

CROSS REFERENCE TO RELATED APPLICATIONS

This application is a national phase application of International Application No. PCT/US2008/060058, filed Apr. 11, 2008, which claims the benefit of U.S. Provisional Patent Application No. 60/911,177, filed Apr. 11, 2007, both of which are incorporated by reference herein in their entireties.

BACKGROUND OF THE INVENTION

1. Field of the Invention

The invention relates generally to the formation of metal items and specifically to reinforcing drawn or stretched metal items.

2. Description of the Related Art

Metal items are frequently fabricated from sheets of metal stock that are punched, trimmed, stamped, and/or drawn into the finished item. The fabrication process frequently involves progressively forming the item in a sequence of manufacturing steps, which may include punching openings into the stock, trimming material from the stock, and stamping or drawing the item into the finished configuration through the use of molds, dies, presses, and the like. The process of stretching the metal can introduce areas of weakness in the finished item, particularly in portions where an annulus is drawn. In such situations, stamping or drawing operations can stretch the stock into areas of relative thinness, which consequently have an increased susceptibility to fatigue and corrosion, thereby shortening the useful life of the item.

Selected portions of items fabricated in this way are frequently reinforced by adding supplemental material in selected areas, typically by welding or brazing operations. Alternatively, parts of the item that are susceptible to such weakness can be separately fabricated in order to avoid the stretching and thinning of the material, and then attached to the item. However, both of these techniques add fabrication steps, increase the handling of the item, and increase the complexity and cost of fabricating the item. Another recognized method of maintaining strength in a stretched metal item is to increase the base metal stock thickness so that all drawn portions exceed specifications. But the consequent item will cost more and weigh more, resulting in needless waste. There is a need for reinforcing portions of an item that have been weakened as a result of a stretching operation in a manner that is easy to fabricate and relatively inexpensive.

SUMMARY OF THE INVENTION

A reinforcement in a stretched metal work piece is formed by a punch driven against an inwardly-directed flange circumscribing an opening defined by an annular wall, at the terminal end of the stretched work piece. The flange is folded against the annular wall by the action of the punch to form a double wall.

DESCRIPTION OF EMBODIMENTS OF THE INVENTION

Figure 1:
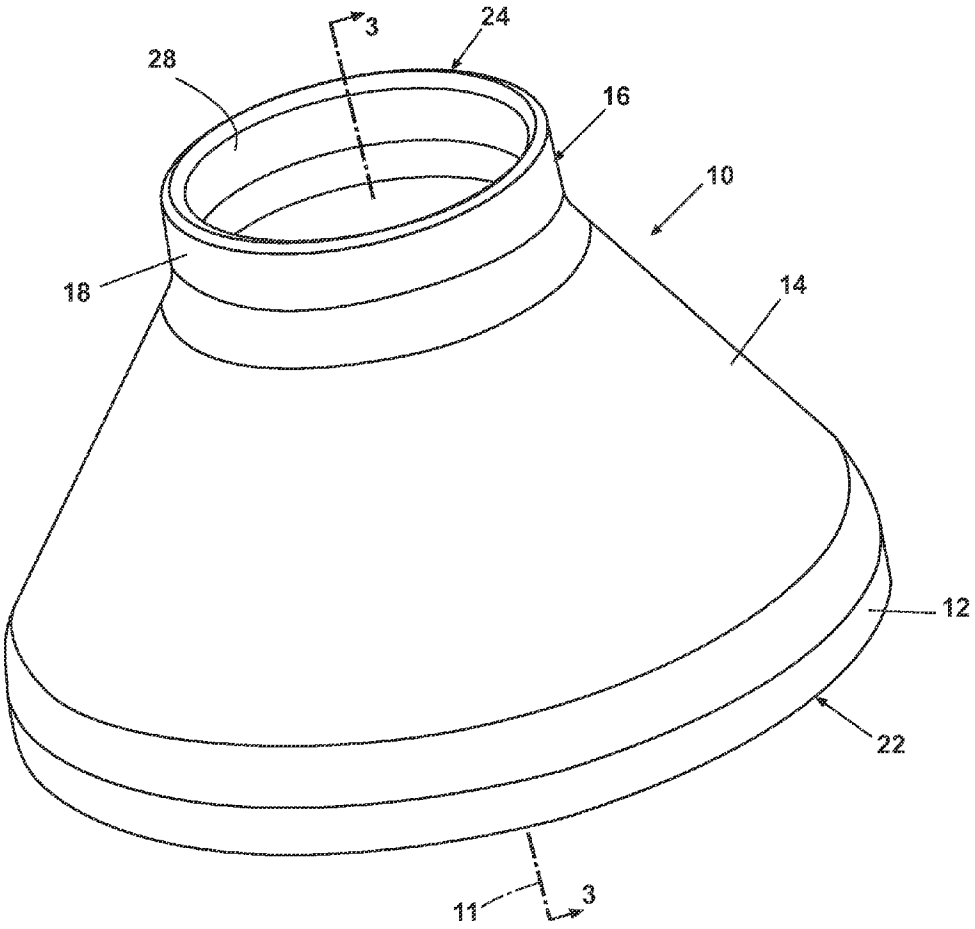
FIG. 1 is a first perspective view of a first embodiment of the invention in a conical catalytic converter end having a reinforced wall.
Figure 2:
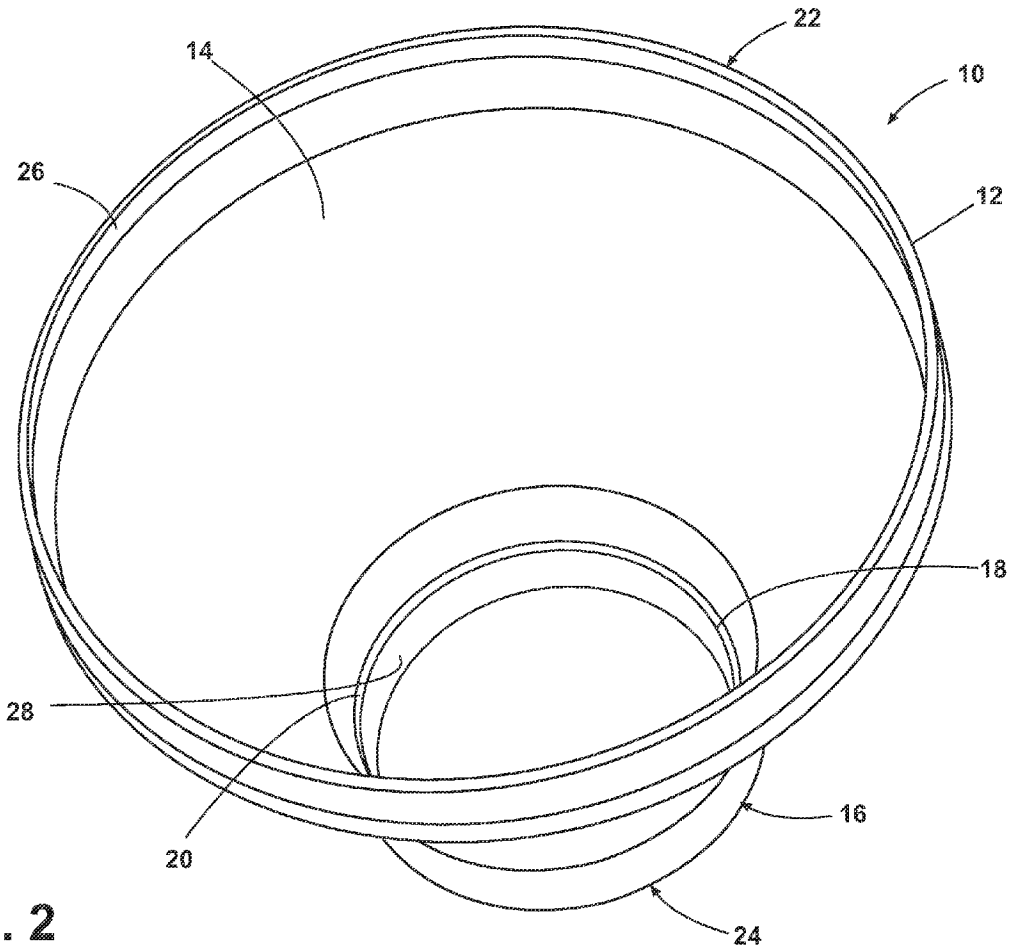
FIG. 2 is a second perspective view of the conical catalytic converter end illustrated in FIG. 1.
Figure 3:
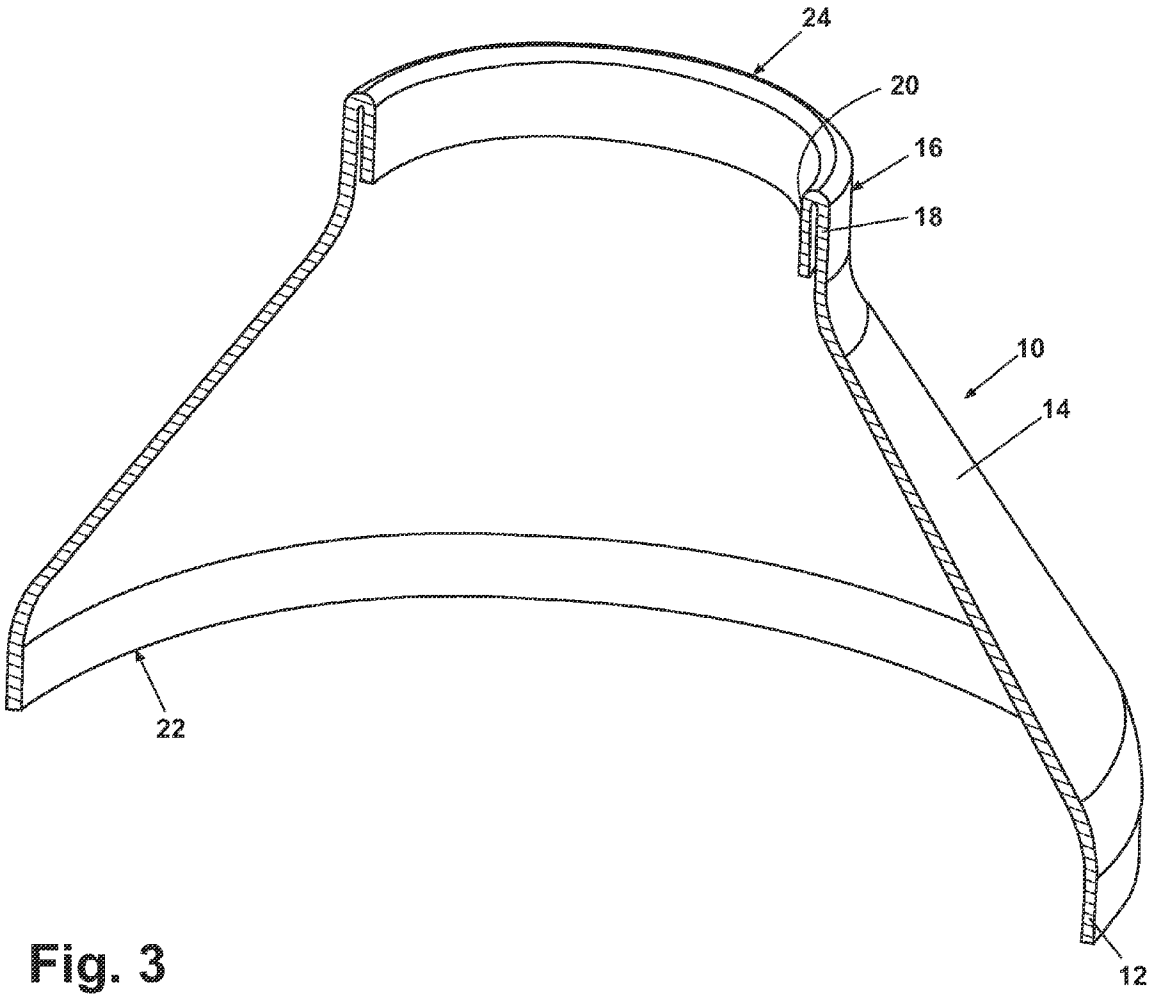
FIG. 3 is a sectional view of the conical catalytic converter end taken along view line 3-3 of FIG. 1.

Referring now to the drawings, and in particular to FIGS. 1-3, a first embodiment of the invention is illustrated in a conical catalytic converter end 10 for use in a vehicular catalytic converter comprising a "reverse extrusion," hereinafter referred to also as a reinforcing wall. The conical catalytic converter end 10 is fabricated from planar steel stock through a sequence of punching, trimming, and stamping steps utilizing dies, molds, presses, and the like, as hereinafter described.

The conical catalytic converter end 10 is a generally symmetrical shell-like body having a longitudinal axis 11 extending through a circular first end 22 and a circular second end 24. While the body is shown here as symmetrical, it need not be, and can take any shape desired under particular circumstances. The diameter of the first end 22 is greater than the diameter of the second end 24. The first end 22 comprises a circular rim 12 defining a first circular opening 26. The second end 24 comprises an annular terminal portion 16 defining a second circular opening 28. A transition portion 14 extends from the circular rim 12 to the annular terminal portion 16 and has the general shape of a truncated cone. The annular terminal portion 16 comprises a neck 18 having a reinforcing wall 20 formed circumferentially about the interior periphery of the terminal portion 16 according to the invention.

As will be explained in greater detail hereinafter, the conical catalytic converter end 10 is formed by drawing or stretching metal from a planar blank along the longitudinal axis 11. It will be understood that stretching the metal in this manner does not result in a uniform thickness; frequently, the thickness of the metal at the annular terminal portion 16 will be less than at other areas of the workpiece. In accord with the invention, the annular terminal portion 16 is drawn with a length longer than that of the finished neck 18, preferably about twice as long. As the conical catalytic converter end 10 is completed, the annular terminal portion 16 is formed by folding approximately one-half of the material radially inwardly along the inner periphery of the neck 18 to create the reinforcing wall 20. Consequently, the annular terminal portion 16 will be reinforced with a double wall.

Figure 4:
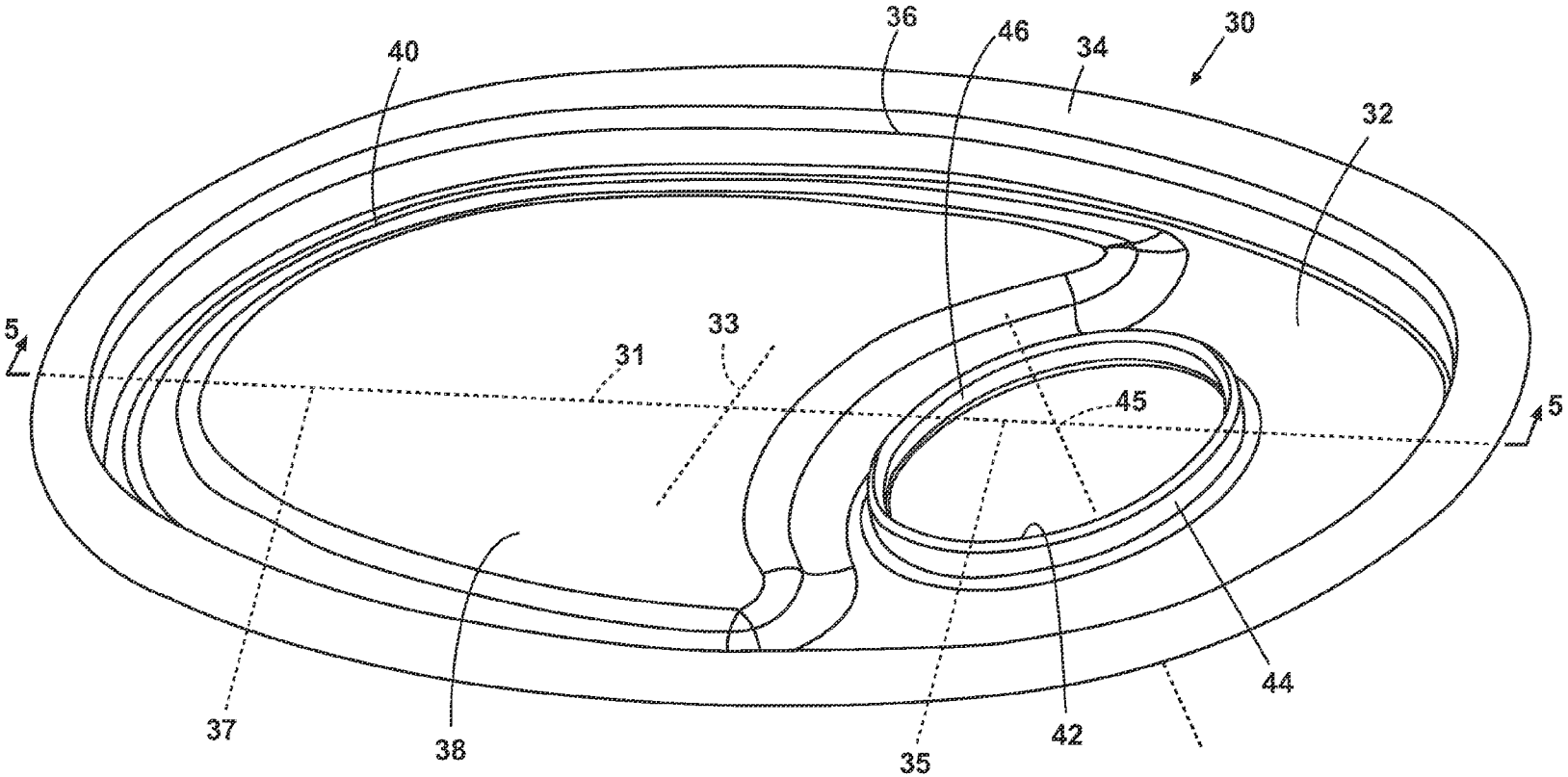
FIG. 4 is a perspective view of a second embodiment of the invention in a muffler head having a reinforced wall.
Figure 5:
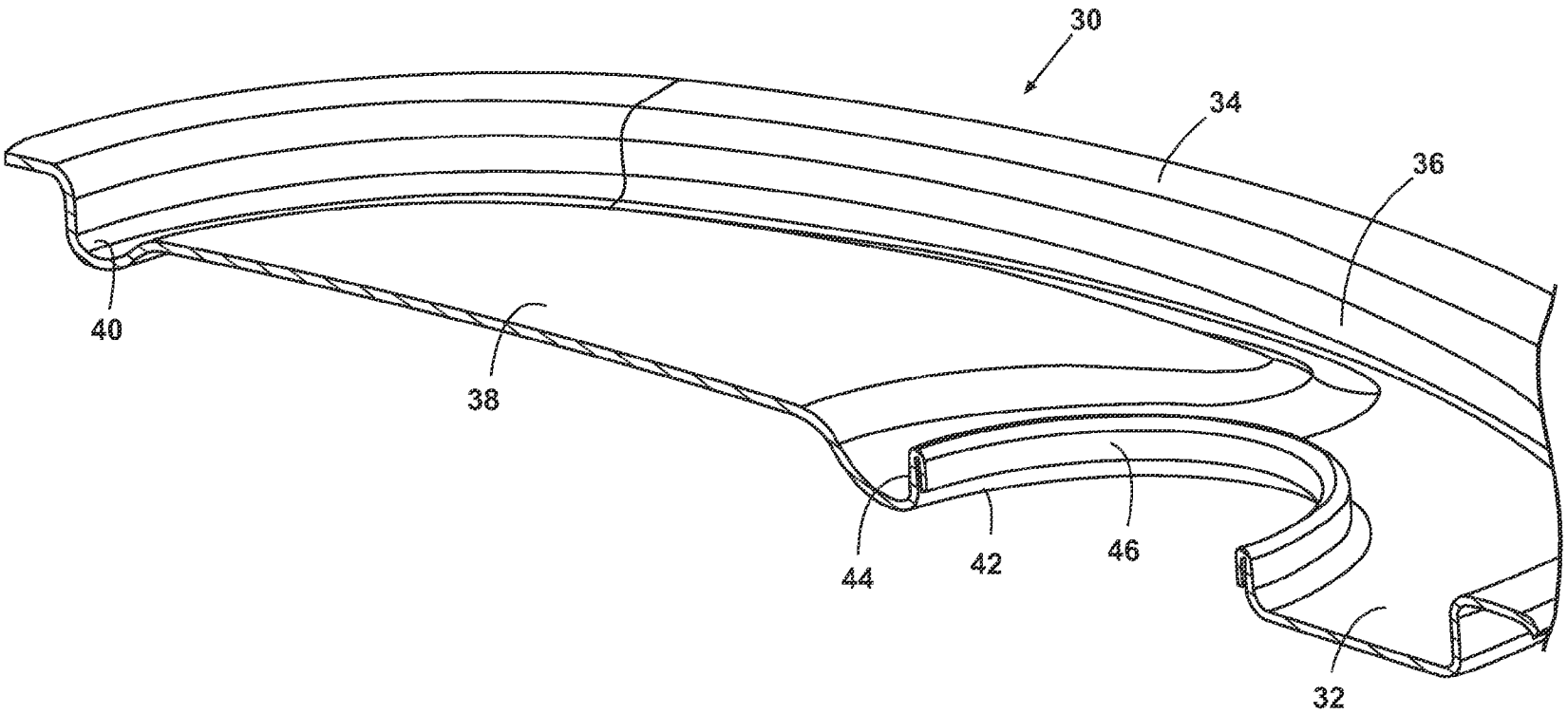
FIG. 5 is a sectional view of the muffler head taken along the view line 5-5 of FIG. 4.

Referring now to FIGS. 4 and 5, a second embodiment of the invention in a vehicle muffler head is illustrated. The muffler head 30 is a generally elliptical, plate-like body having a major axis 31 and a minor axis 33. The muffler head 30 comprises an elliptical center wall 32 transitioning peripherally to an elliptical peripheral flange 34 through an elliptical wall 36 extending generally orthogonal to the center wall 32 and the peripheral flange 34.

An opening 42 penetrates the end wall 32 symmetrically about the major axis 31 and to a first side 35 of the minor axis 33. The opening 42 is circumscribed by a raised annular lip 44, drawn along a longitudinal axis 45, and having an inwardly-extending peripheral reinforcing wall 46, formed according to the invention.

A somewhat D-shaped raised portion 38 extends symmetrically along the major axis 31 from the opening 42 to a second side 37 of the minor axis 33 opposite the first side 35. The periphery of the raised portion 38 is spaced inwardly somewhat from the elliptical wall 36 to define a generally elliptical channelway 40.

Figure 6:
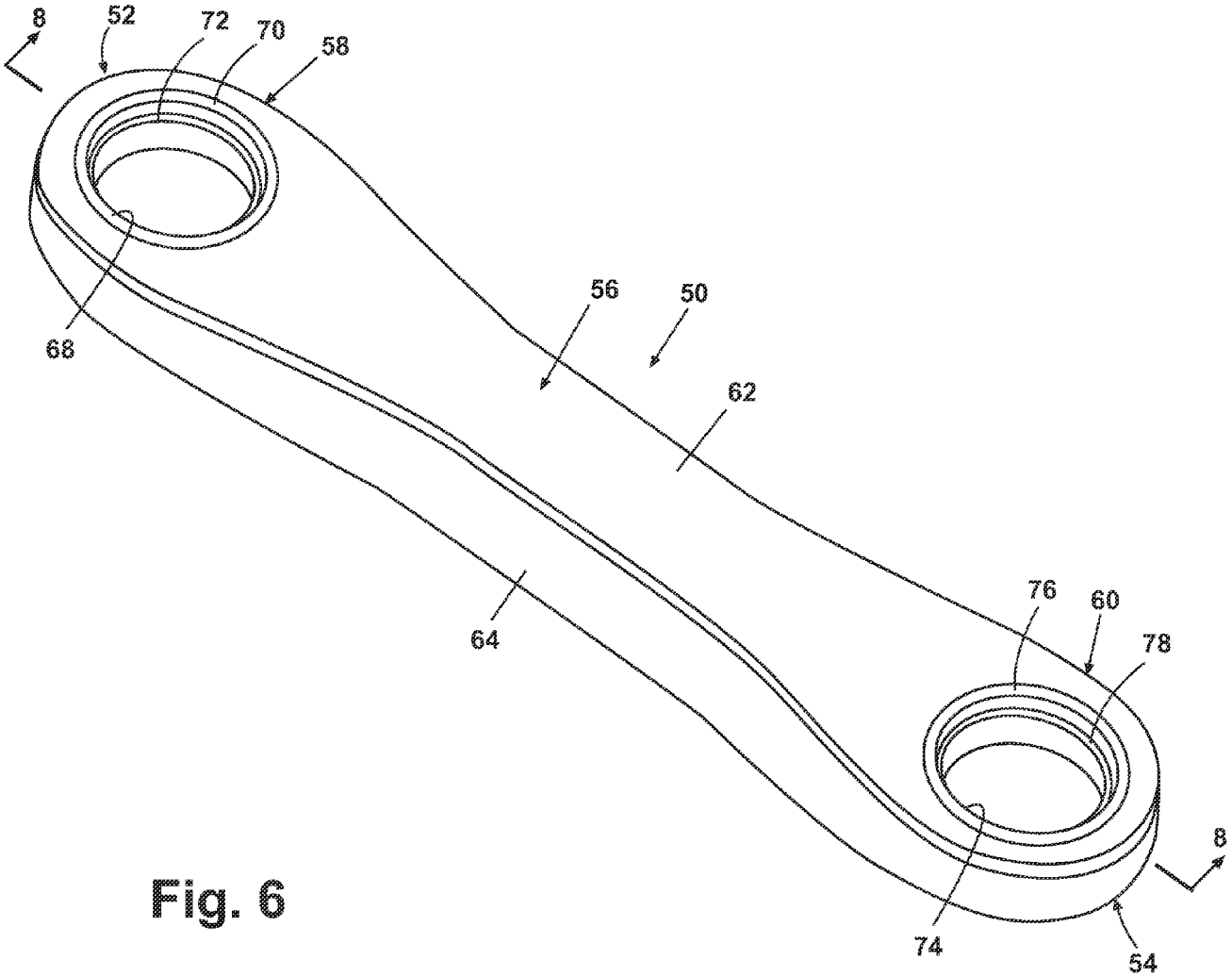
FIG. 6 is a first perspective view of a third embodiment of the invention in a dog bone having a reinforced wall.
Figure 7:
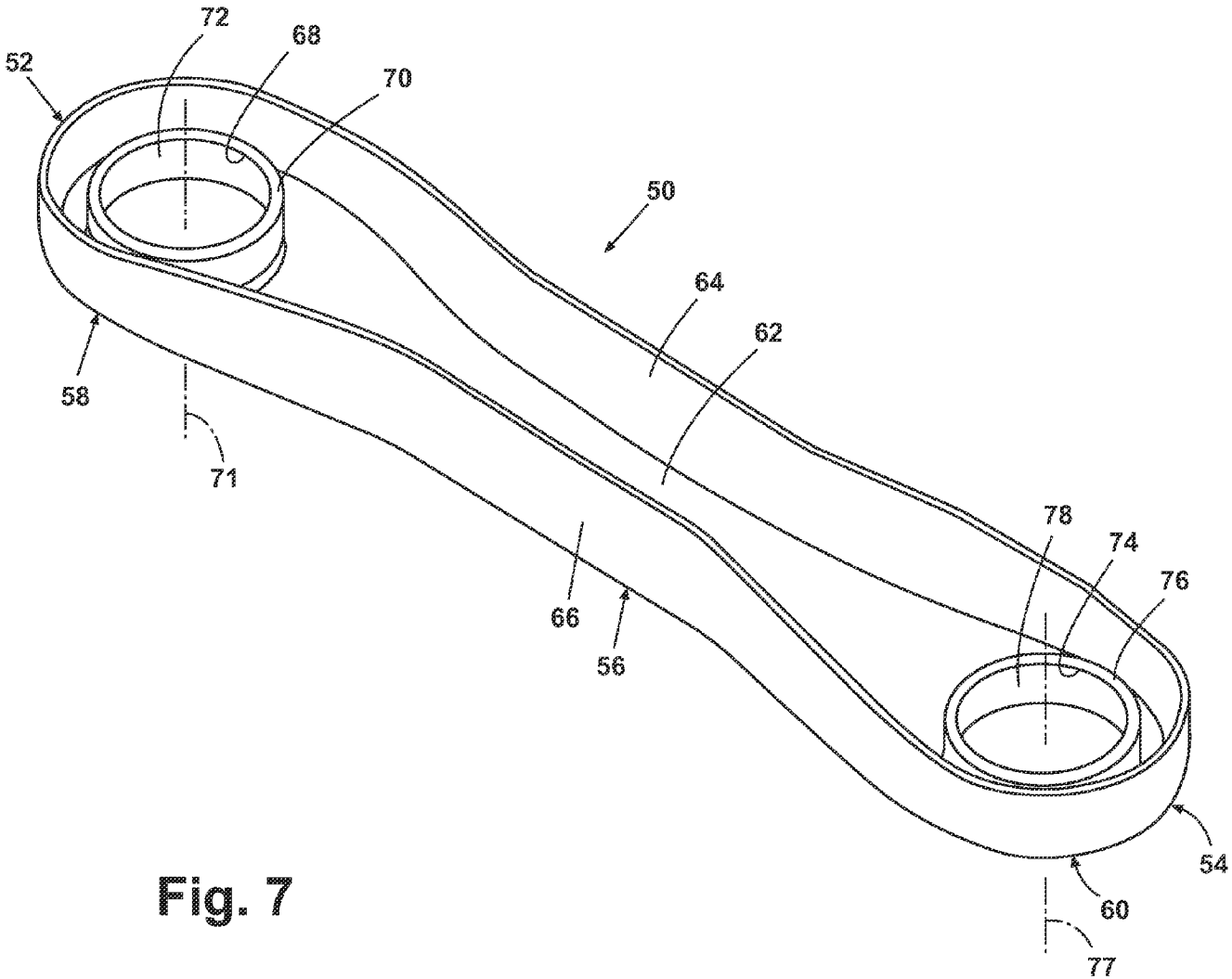
FIG. 7 is a second perspective view of the dog bone illustrated in FIG. 6.
Figure 8:
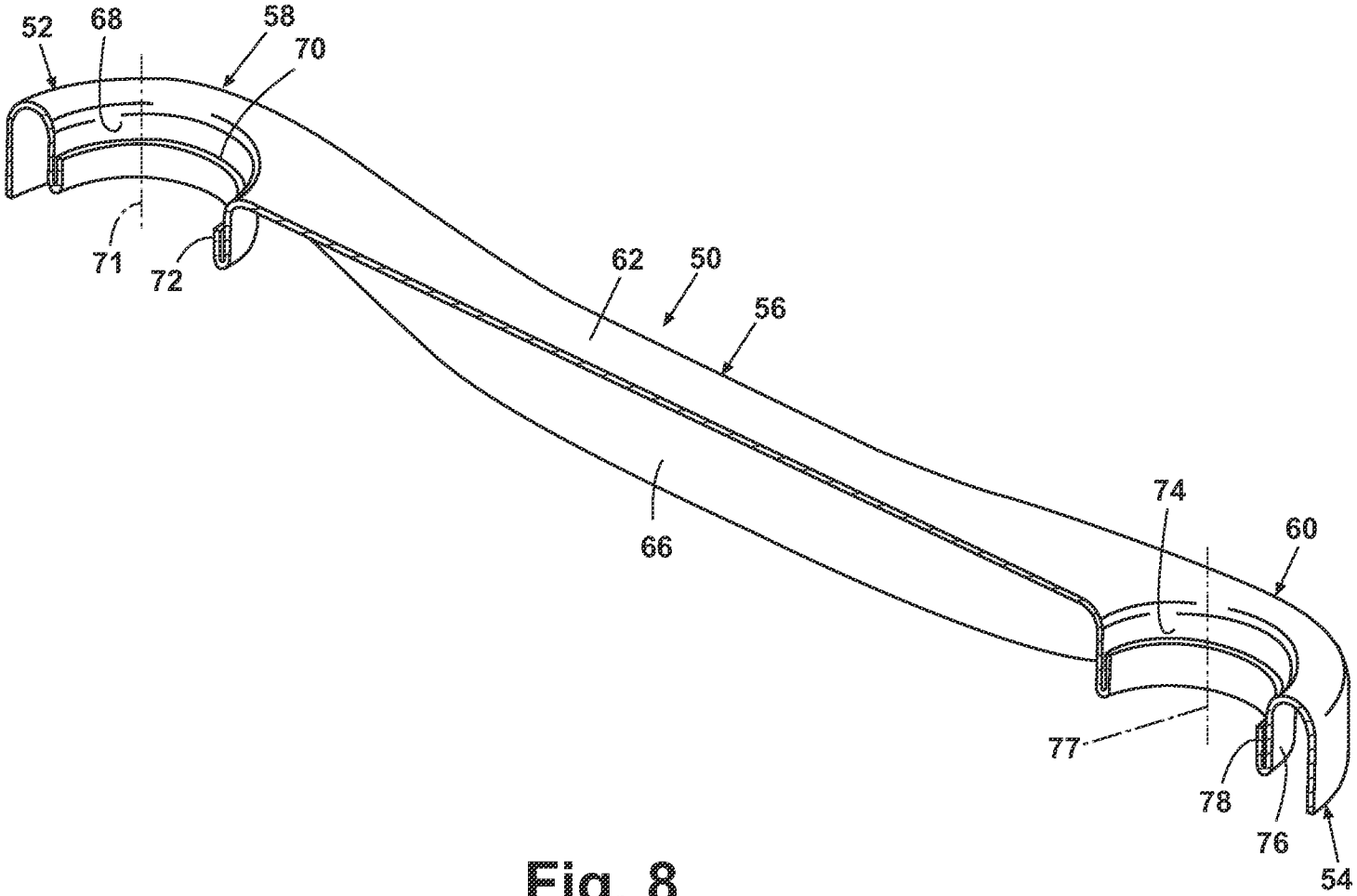
FIG. 8 is a sectional view of the dog bone taken along view line 8-8 of FIG. 6.

Referring now to FIGS. 6-8, a third embodiment of the invention is illustrated in what is commonly referred to as a dog bone 50, commonly used in vehicle chassis assemblies. The dog bone 50 is a linkage piece for connecting a vehicle rear axle suspension to the vehicle body. The dog bone 50 is an elongated member comprising a first end 52 and a second end 54 joined by a center portion 56. The first end 52 comprises a widened portion 58, and the second end 54 comprises a widened portion 60. The dog bone 50 comprises a main wall 62 and a pair of depending side walls 64, 66. An opening 68 extends through the first end 52 having a depending annular wall 70 extending along a longitudinal axis 71 with a reinforcing wall 72 formed according to the invention. A second opening 74 extends through the second end 54 having a depending annular wall 76 extending along a longitudinal axis 77 with a reinforcing wall 78 formed according to the invention. The reinforcing walls 72, 78 are formed circumferentially about the interior periphery of the annular walls 70, 76.

The fabrication of the conical catalytic converter end 10, muffler head 30, and dog bone 50 are similar in many respects, particularly with respect to the formation of their respective reinforcing walls 20, 46, 72, and 78.

Figure 11:
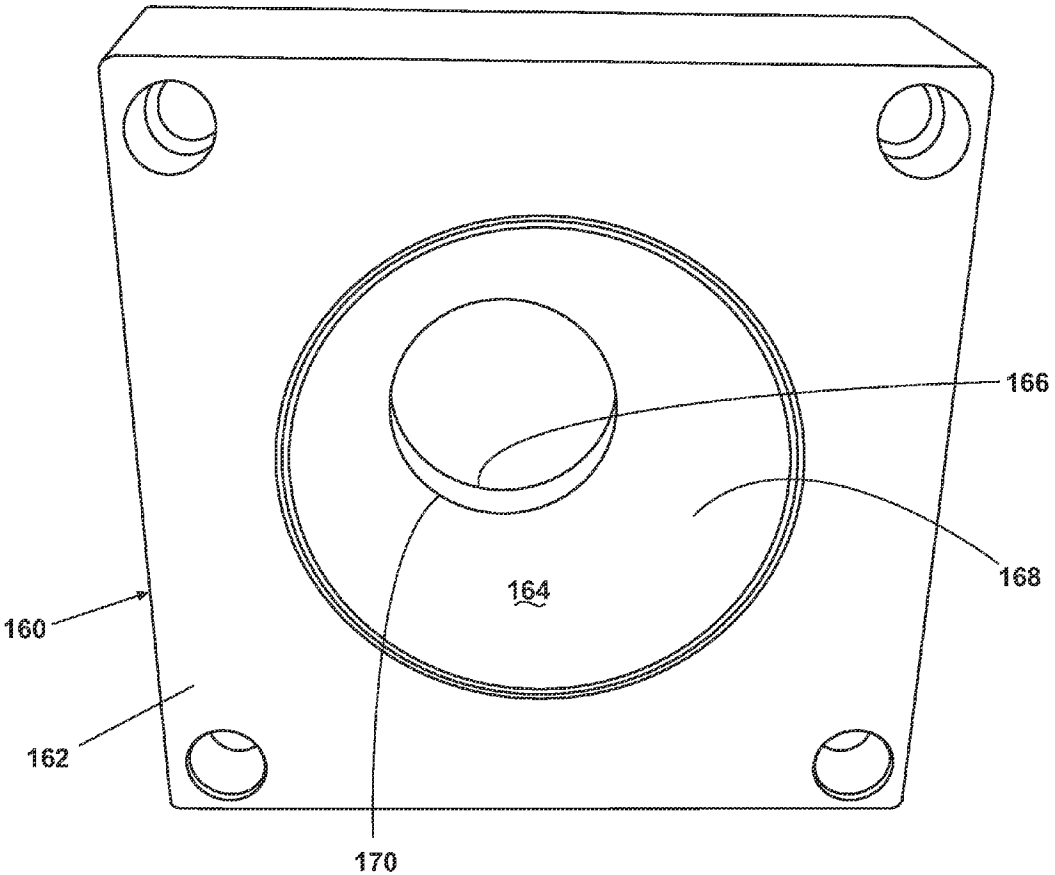
FIG. 11 is a perspective view of a die utilized in the fabrication of the conical catalytic converter end illustrated in FIG. 1.

FIGS. 11-14 illustrate the fabrication of the conical catalytic converter end 10. FIG. 11 illustrates a die 160 utilized in forming the catalytic converter end 10. The die 160 comprises a die body 162, preferably fabricated of high-strength steel having sufficient strength and durability for the purposes described herein, such as American Iron and Steel Institute (AISI) grade 4140 hardened steel. The die body 162 comprises a die cavity 164 in the shape of the catalytic converter end 10 for forming the catalytic converter end against the die 160 through the use of generally well-known stamping and punching techniques. The die cavity 164 terminates in an opening 166 for purposes described hereinafter. The cavity 164 comprises a transition surface 168 corresponding to the transition portion 14 of the finished conical catalytic converter end 10, and a neck surface 170 corresponding to the neck 18 and terminating in the opening 166.

Figure 12:
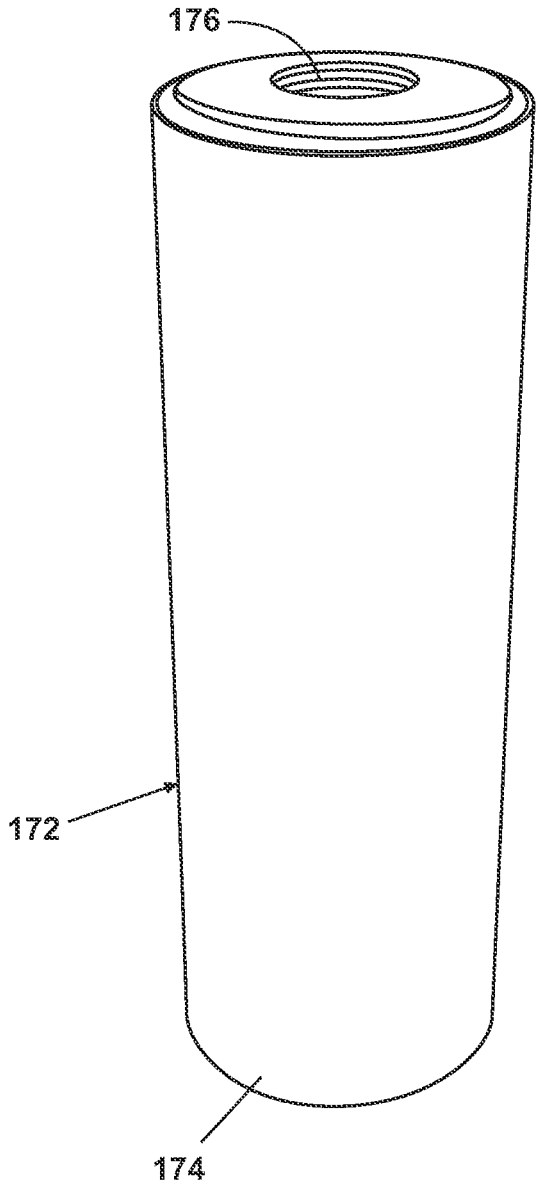
FIG. 12 is a perspective view of a punch utilized in the fabrication of the reinforced wall of the conical catalytic converter end illustrated in FIG. 1.

FIG. 12 illustrates a punch 172 which is utilized to fabricate the reinforcing wall 20. The punch 172 comprises a cylindrical body preferably fabricated of AISI grade 01 tool steel having a tool end 174 for engaging the workpiece, and a mounting bore 176 for attaching the punch 172 to a press. The diameter of the tool end 174 is somewhat less than the diameter of the opening 166 in the die 160 in order to accommodate the die and the double thickness reinforcing wall 20 when the punch 172 is inserted through the opening 166 to form the reinforcing wall 20, as hereinafter described.

Figure 13:
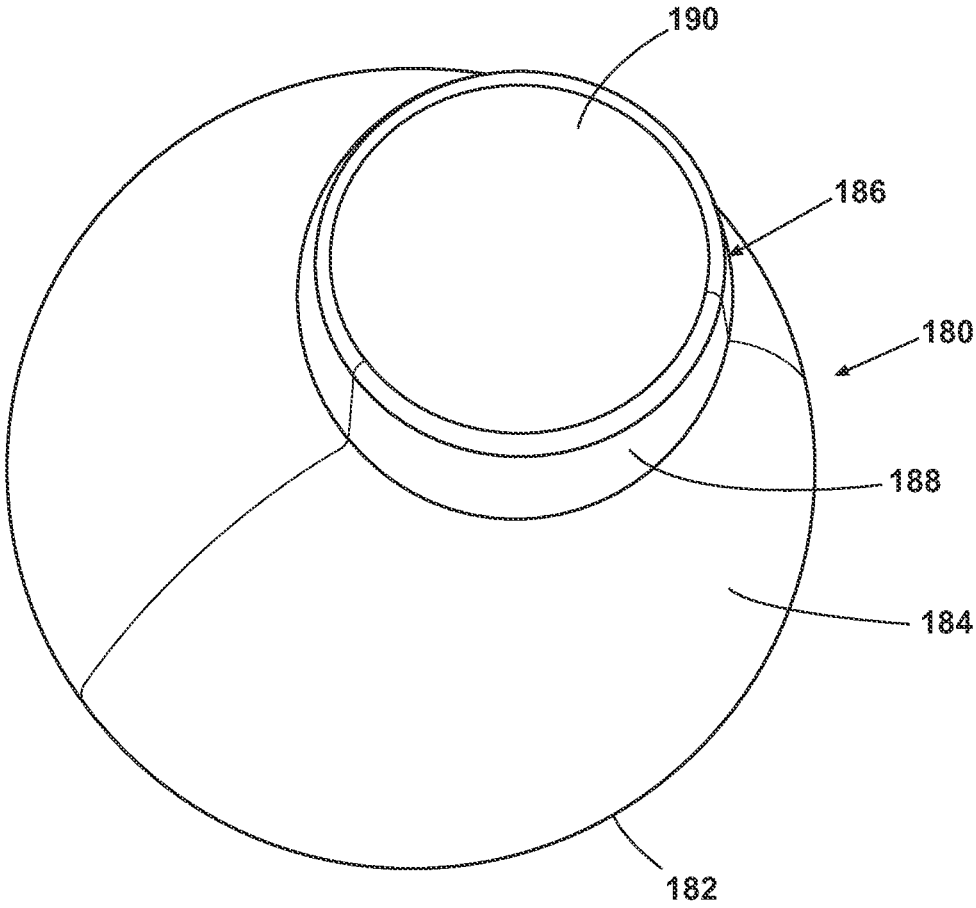
FIG. 13 is a workpiece representing an intermediate step in the formation of the conical catalytic converter end of FIG. 1.
Figure 14:
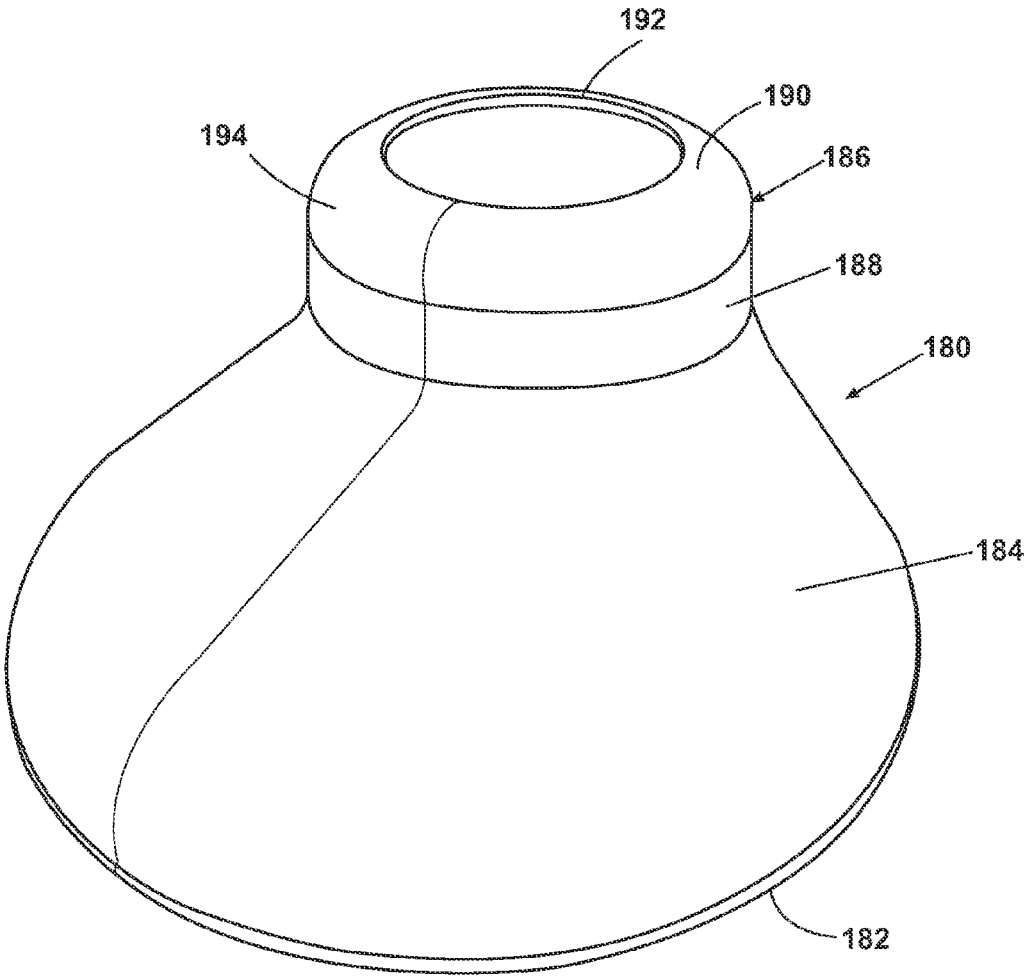
FIG. 14 is the workpiece FIG. 13 representing a subsequent step in the formation of the conical catalytic converter end of FIG. 1.
Figure 15:
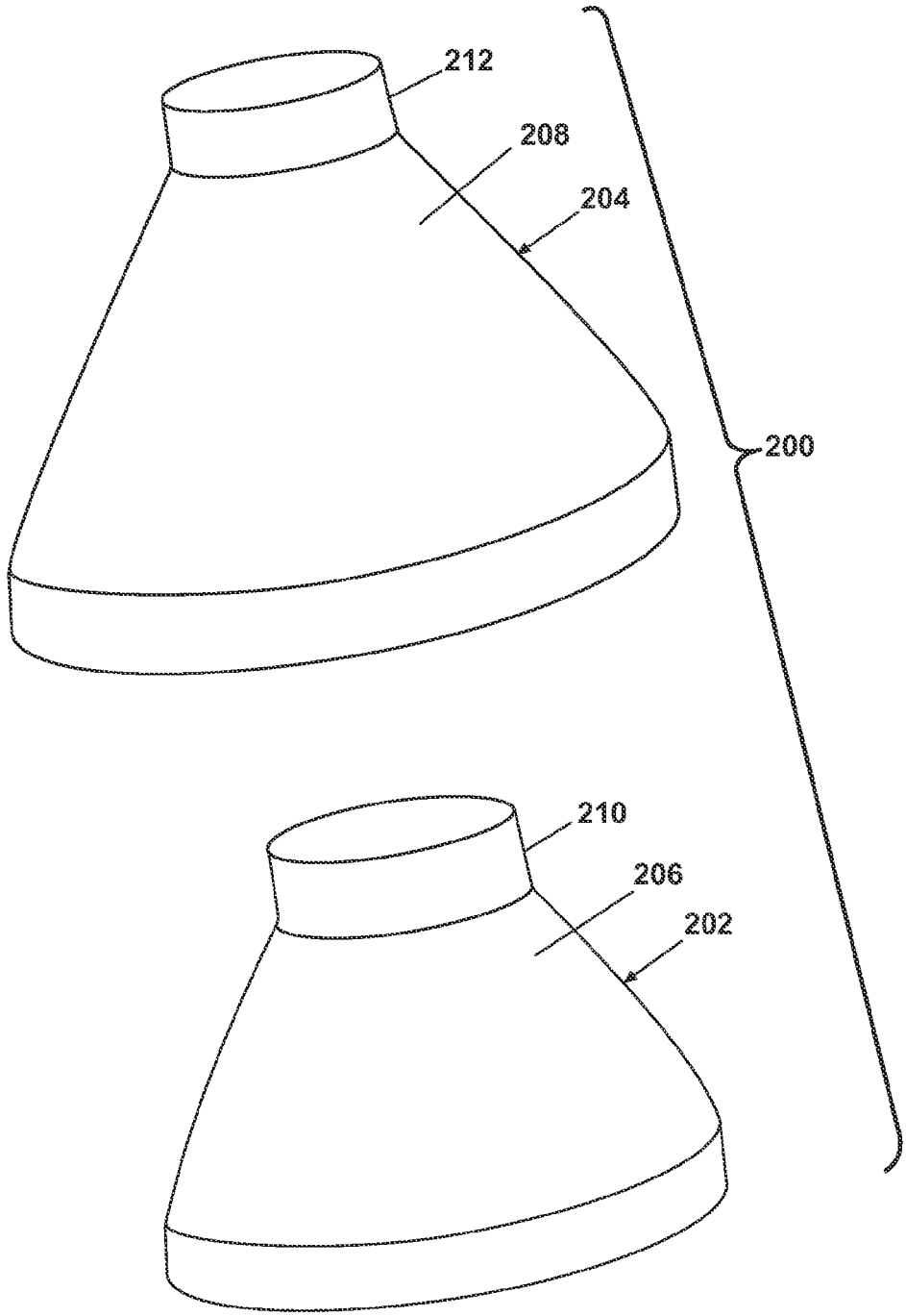
FIG. 15 is a perspective view of another embodiment of the invention in a pair of conical parts adapted for nesting during assembly.
Figure 16:
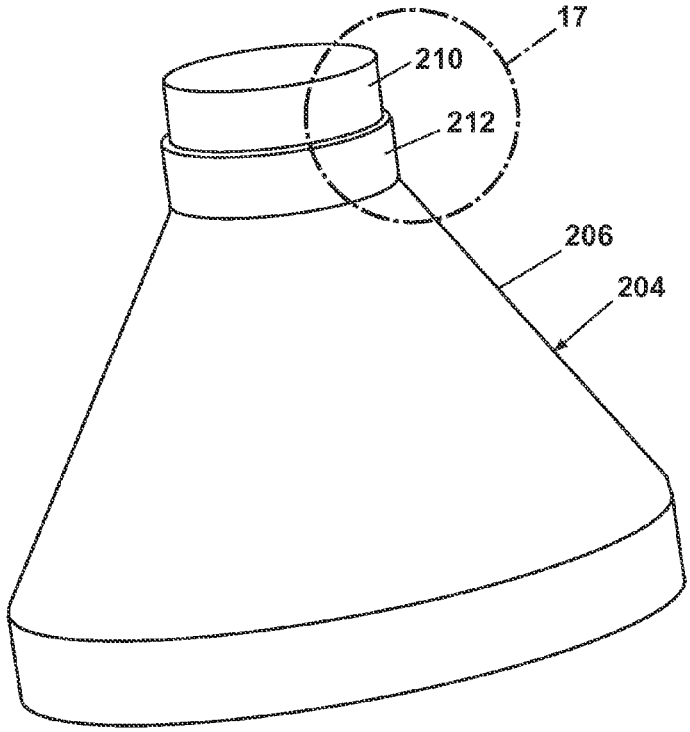
FIG. 16 is the embodiment of FIG. 15 nested together.
Figure 19:
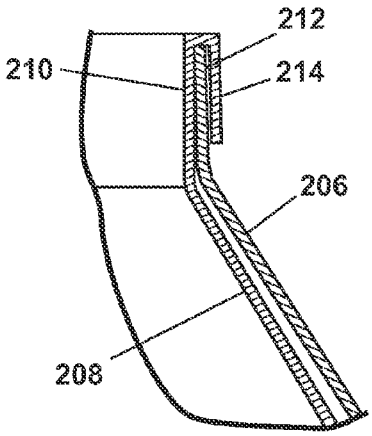
FIG. 19 is an enlarged cross sectional view of the bounded area 19 of FIG. 18.
Figure 17:
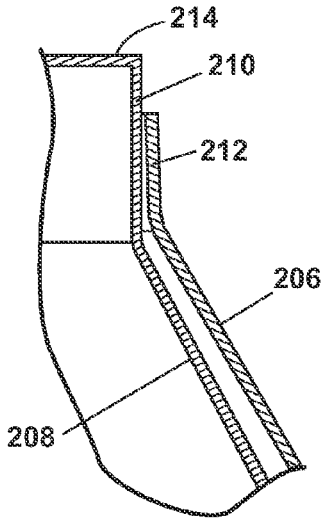
FIG. 17 is an enlarged cross sectional view of the bounded area 17 of FIG. 16.
Figure 18:
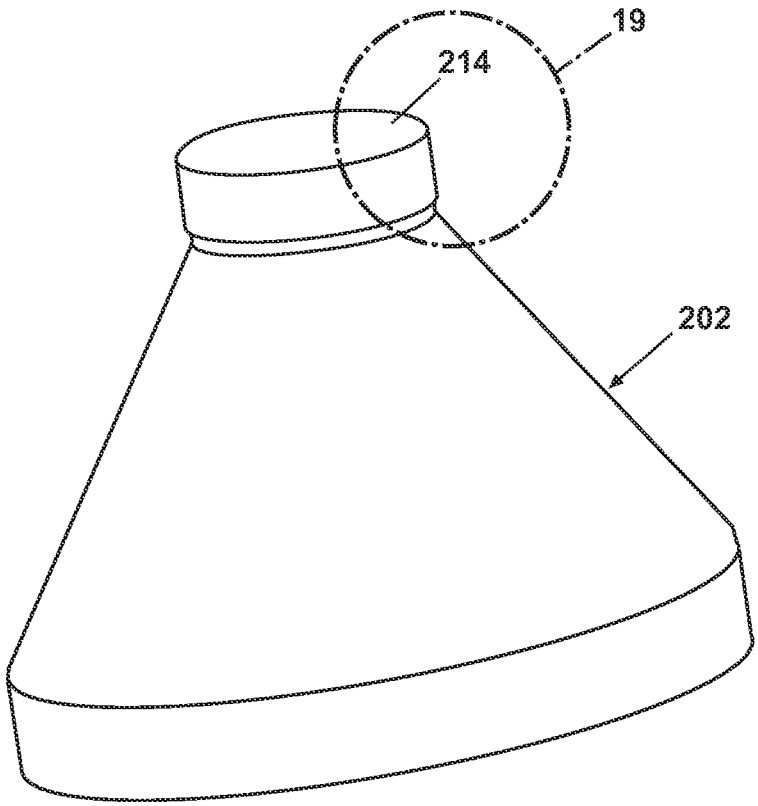
FIG. 18 is the work piece of FIG. 16 completed.

FIG. 13 illustrates an intermediate stage in the formation of the catalytic converter end. In FIG. 13, a conical catalytic converter end workpiece 180 has been initially formed by drawing or stretching flat stock 181 in the die 160. The workpiece 180 has a rim 182, a transition portion 184, and a terminal portion 186, all drawn along a longitudinal axis and having the general shape of the finished end 10. The steps employed to fabricate the end 10 from a piece of planar sheet stock result in a terminal portion 186 comprising an annular neck 188 having a closed end 190. A subsequent step in the fabrication of the catalytic converter end 10 is illustrated in FIG. 14. In FIG. 14, an intermediate opening 192 has been punched through the closed end 190 using a well-known punching technique to define a radially-inwardly directed flange 194 circumscribing the intermediate opening 192.

The opening 192 has a diameter less than the diameter of the finished opening 28. The outside diameter of the annular neck 188 is equal to the outside diameter of the finished neck 18. To fabricate the reinforcing wall, the workpiece 180 remains in the die cavity 164 with an anvil or similar tool having a configuration complementary to the configuration of the workpiece 180 used to urge the workpiece 180 into the cavity 164. The punch 172 is driven against the flange 194, through the intermediate opening 192 and the die opening 166 to drive the flange 194 coaxially within the intermediate opening 192 in a direction toward the rim 182 to form the reinforcing wall 20. Upon retraction of the punch 172 from the die 160, the workpiece 180 will have the reinforcing wall 20 previously described herein.

Figure 9:
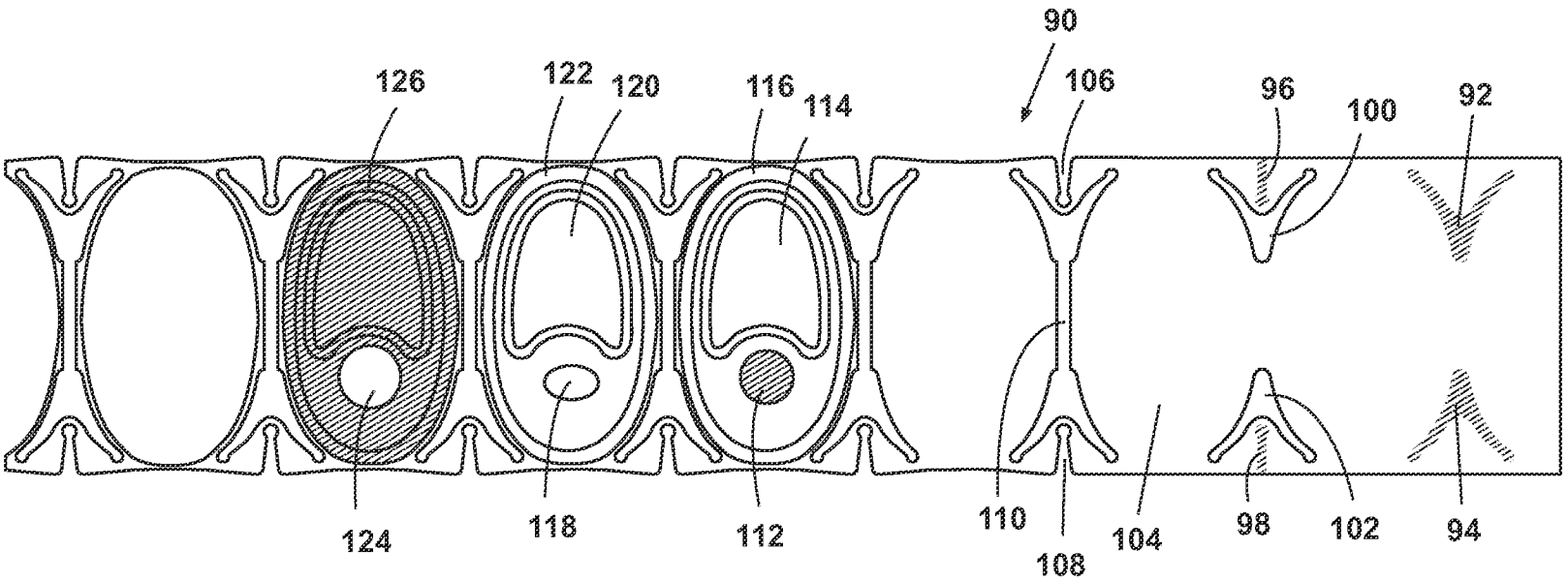
FIG. 9 is a top view of a web according to the invention representing steps involved in fabricating the muffler end plate illustrated in FIG. 4.

The fabrication of the reinforcing walls for the muffler head 30 and the dog bone 50 is similar to the fabrication of the reinforcing wall 20 of the conical catalytic converter end 10. FIG. 9 illustrates a strip layout for the fabrication of the muffler head 30. The strip layout shows the sequence of steps for fabricating a muffler head from planar steel stock according to the invention. In FIG. 9, the sequence of fabrication steps progresses from right to left.

The muffler head 30 is progressively formed from a steel web 90 or ribbon, which is first provided with a pair of somewhat V-shaped punch out marks 92, 94 for defining a roughly overall oval configuration of the muffler head. Finish punch outs 100, 102 are stamped at the punch out marks 92, 94. The web 90 is also provided with a pair of key punch out marks 96, 98 adjacent to respective finish punch outs 100, 102, and which are stamped to form finished key punch outs 106, 108. The finished key punch outs 106, 108 are used in aligning the steel web 90 with the various dyes and punches used to form the muffler head 30. The finish punch outs 100, 102 define a rough muffler head blank 104 having a pair of finished key punch outs 106, 108. Concurrently, an edge punchout 110 is formed joining the punchouts 100, 102 at their vertices.

A closed punch out 112 is drawn or stretched that corresponds to the opening 42, and an annular wall 113 with a closed end 115. The blank 104 is also worked to form a raised portion stamping 114 that will become the raised portion 38, and a peripheral flange stamping 116 that will become the peripheral flange 34.

An intermediate opening 118 is then formed as by stamping in the closed end 115 of the closed punch out 112 defined by a periphery 119 and having a configuration prepared for the formation of the reinforcing wall as described generally herein with respect to the conical catalytic converter end. The raised portion stamping 114 and peripheral flange stamping 116 are finished at 120 and 122 respectively, to create the final configuration of the peripheral flange 34 and the raised portion 38. The opening 118 is punched by a tool having a diameter roughly equal to the desired diameter of the opening 42 in the muffler head 30 and larger than the opening 118. As the tool is urged against the periphery 119, it draws or stretches the periphery 119 against the adjacent wall of the punch out 112 as at 124 forming the opening 42 finished with the reinforcing wall 46. The muffler head 126 is then punched out from the steel web 90.

It will be understood that each station step in FIG. 9 can be designed into a single press having multiple tools so that with each press, all of the steps shown in FIG. 9 can occur simultaneously. The web 90 will be advanced by an indexed amount after each press, using, for example, the finished key punch outs 106, 108.

Figure 10:
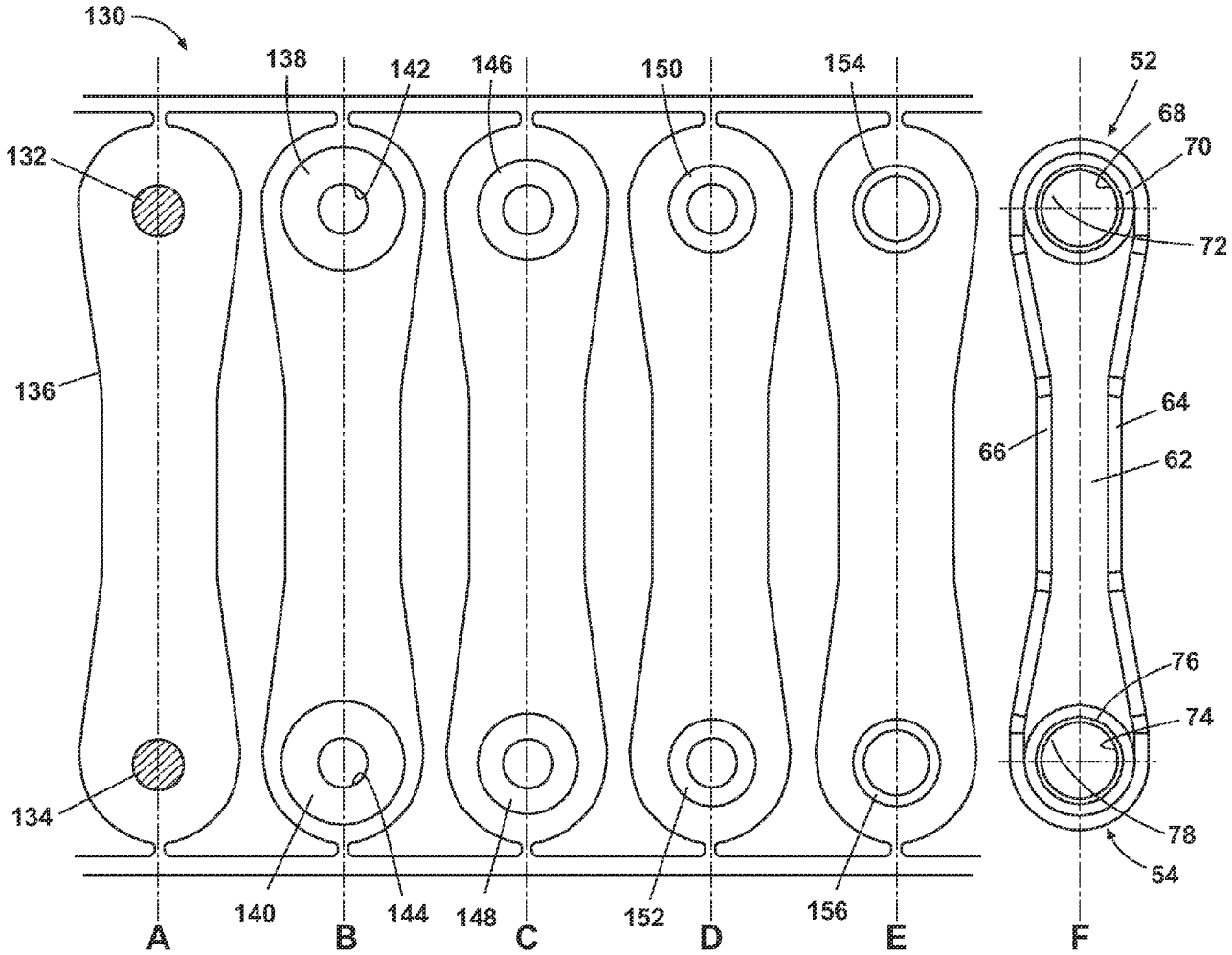
FIG. 10 is a top view of a web according to the invention representing steps involved in fabricating the dog bone illustrated in FIG. 6.

Referring to FIG. 10, a similar sequence of steps is utilized to fabricate the dog bone 50. A steel web 130 is initially punched out to form dog bone blanks through a periphery cut 136 which leaves the dog bone blanks attached to the web through small tabs at each end of the blank. Punch outs 132, 134 form intermediate openings in each end of the dog bone (trim step "A"). In bubble form step "B," annular wall stampings 138, 140 are initiated for each end of the blank, drawing metal out of the plane into a "bubble" shape. The intermediate openings 132, 134 are enlarged as each "bubble" is raised relative to the original plane of the blank, and as each wall stamping 138, 140 is extended to eventually become the annular walls 70, 76. In form step "C," the annular wall stampings 138, 140 are further extended away from the original plane of the steel web 130. In form step "D," further formation of the annular wall stampings 138, 140 is completed. At this stage, the annular wall stampings form annular walls 142, 144, respectively, each terminating in a radially-inwardly directed flange or periphery 146, 148 circumscribing the respective intermediate openings 132, 134. In pre-trim step "E," the annular walls 142, 144 are fully formed, terminating in radially inwardly extending flanges 146, 148 and intermediate openings 132, 134. In the final, wipe step "F," the reinforcing walls 72, 78 are formed by punching tools through the intermediate openings 132, 134, urging the peripheral material against the adjoining annular walks 142, 144 to from the reinforcing walls 72, 78. As well, the side walls 64, 66 are formed in a conventional manner by pressing in a die.

In all embodiments, the formation of the reinforcing walls is effected by working the blank against a die. Specifically, the formation of a reinforcing wall is accomplished by positioning the workpiece against the die and driving a punch against a radially-inwardly directed flange circumscribing an opening in the workpiece to draw the flange against the inner circumference of the annular wall. This is accomplished by a punch having a suitable diameter moving at a frequency of 30 to 45 strokes per minute. A total of 2-3 strokes has been found sufficient to satisfactorily form the reinforcing wall. An anvil having a shape complementary to the die against which the workpiece is formed can be used to hold the workpiece in place while the punch is applied to the workpiece to form the reinforcing wall.

The die preferably comprises hardened AISI grade 4140 hardened steel. The punch preferably comprises AISI grade 01 tool steel.

The reinforcing wall described herein can be readily fabricated by modifying the tooling required for the finished product, and adding a final punching step to extend the reinforcing wall against the annular wall to provide a wall having a double thickness of material. The double thickness annular wall provides enhanced durability and resistance to the effects of corrosion and fatigue experienced by a single thickness wall.

The foregoing processes can be used to make yet another embodiment as shown in FIGS. 15-19. Here, a conical part 200, similar to that shown in FIGS. 1-3, is formed with a double wall. An interior cone 202 is formed by the foregoing process, as is an exterior cone 204 of nominally larger dimensions, sufficiently large enough to receive the interior cone 202 in nesting relationship with the walls 206, 208 slightly spaced from each other. Each cone 202, 204 has a terminal neck 210, 212, with the interior neck 210, as shown, being longer than the exterior neck 212. When the cones 202, 204 are nested, the interior terminal neck 210 is sized to extend past the exterior terminal neck 212, or conversely, the exterior terminal neck 212 can be sized to extend past the interior terminal neck 210. Either way, the extension 214 is folded over the adjacent neck to form a reinforcement at the terminal end of the conical part 200, with a double walled body. It will be understood that this double wall concept can be applied to any shaped work piece having drawn or stretched metal components with a terminal edge needing reinforcement.

It will be understood that the reinforcing wall need not be folded inwardly as in the embodiments of FIGS. 1-14, but can also be folded outwardly as in the embodiment of FIGS. 15-19. Thus, for example, the annular wall 12 of the first end 22 of the conical catalytic converter end 10 can be reinforced by folding the wall back on itself, either to the inside or to the outside. When forming a reinforcing a wall to the outside, the folding step will include flaring the periphery to a diameter larger than the intermediate opening and folding the periphery against an exterior annular wall.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of forming a stretched metal workpiece having a reinforced terminal wall comprising the steps:

providing a die body defining a first longitudinal axis, and a complementary cylindrical drawing punch defining a second longitudinal axis;

orienting a planar metal blank orthogonal to said first longitudinal axis;

constructing a first annular wall transitioning immediately to a closed end orthogonal to said first longitudinal axis by stretching said planar metal blank against said die body along said first longitudinal axis;

forming an intermediate opening in said closed end circumscribed by a second annular wall extending radially away from said first annular wall by removing a portion of said closed end; and folding said second annular wall against said first annular wall to form said reinforced terminal wall by moving said complementary cylindrical drawing punch against said second annular wall along said second longitudinal axis collinear with said first longitudinal axis.

2. The method of claim 1 wherein said closed end includes an exterior surface and an opposed interior surface, and the removing of said portion of said closed end includes punching said intermediate opening with a hole-forming punch against one of said exterior and interior surfaces and an anvil against the other of said exterior and interior surfaces.

3. The method of claim 2 wherein the folding step includes providing said complementary cylindrical drawing punch with a diameter substantially similar to a predetermined final reinforced terminal wall diameter and moving said complementary cylindrical drawing punch against said second annular wall.

4. The method of claim 3 wherein the folding step includes collinearly aligning said first longitudinal axis and said second longitudinal axis, and moving said complementary cylindrical drawing punch toward said die body.

5. The method of claim 4 wherein the folding step includes flaring said second annular wall to a diameter larger than said intermediate opening and folding said second annular wall against an exterior of said first annular wall.

6. The method of claim 4 wherein said metal blank is a web.

7. The method of claim 6 wherein all steps occur simultaneously in different portions of said web by a single motion of a press, and said web is advanced by an indexed amount for each successive motion of said press.

8. The method of claim 4 wherein the folding step includes providing said complementary cylindrical drawing punch with a diameter substantially similar to a predetermined final reinforced terminal wall diameter and moving said complementary cylindrical drawing punch against said second annular wall.

9. The method of claim 2 wherein the folding step includes flaring said second annular wall to a diameter larger than said intermediate opening and folding said second annular wall against an exterior of said first annular wall.

10. The method of claim 9 wherein said metal blank is a web.

11. The method of claim 10 wherein all steps occur simultaneously in different portions of said web by a single motion of a press, and said web is advanced by an indexed amount for each successive motion of said press.

12. The method of claim 1 wherein said stretched metal workpiece is one of a catalytic converter, a muffler head, and a dog bone.

13. A method of forming a stretched metal workpiece having a reinforced terminal wall comprising the steps:

providing a die body and a complementary punch, said die body having a single configuration and defining a first longitudinal axis;

positioning an unstretched planar metal blank against said die body orthogonal to said first longitudinal axis;

forming a first annular wall having an exterior surface and transitioning immediately to a closed end orthogonal to said first longitudinal axis by stretching said unstretched planar metal blank against said die body along said first longitudinal axis;

while maintaining said stretched metal blank against said die body, forming an opening in said closed end, said opening circumscribed by a second annular wall extending radially away from said first annular wall; and folding said second annular wall along said first annular wall to form said reinforced terminal wall by moving said complementary punch orthogonally against said second annular wall.

* * * * *